United States Patent [19]

Mitchell

[11] 4,185,946

[45] Jan. 29, 1980

[54] RESILIENT INTAKE AND EXHAUST VALVE

[76] Inventor: Ronald H. Mitchell, 903 Sandifer, Longview, Tex. 75601

[21] Appl. No.: 884,133

[22] Filed: Mar. 7, 1978

[51] Int. Cl.[2] ..... F04B 3/00

[52] U.S. Cl. ..... 417/254; 137/512; 417/560; 417/566; 417/571

[58] Field of Search ..... 417/254, 266, 268, 566, 417/560, 559, 571; 137/512, 512.4

[56] References Cited

U.S. PATENT DOCUMENTS

| | | | |
|---|---|---|---|
| 1,139,991 | 5/1915 | Melmore | 417/254 |
| 2,081,222 | 5/1937 | Coberly | 417/571 |
| 2,628,563 | 2/1953 | Coberly | 417/566 X |
| 2,902,049 | 9/1959 | Ilfrey et al. | 417/566 X |
| 4,032,266 | 6/1977 | Roeder | 417/571 |
| 4,084,606 | 4/1978 | Mittleman | 417/566 X |

*Primary Examiner*—Carlton R. Croyle
*Assistant Examiner*—Edward Look
*Attorney, Agent, or Firm*—Marcus L. Bates

[57] ABSTRACT

A downhole pump has spaced upper and lower pistons connected together by a common rod so that the pistons reciprocate within a cylinder. The cylinder is separated into an upper and lower engine chamber by a frame supported from the cylinder wall and arranged laterally with respect to the longitudinal axial centerline of the connecting rod. A bushing is positioned centrally of the frame and sealingly engages a reciprocating marginal length of the connecting rod. An exhaust port is formed through the frame in spaced relationship to the bushing. A resilient exhaust valve element surrounds the bushing and includes a lower, circumferentially extending edge affixed to the frame outwardly of the exhaust port and further includes an upper seal end which sealingly engages a marginal external surface of the bushing. A lower resilient intake valve element circumferentially extends about the connecting rod in spaced relationship therewith and has an upper end attached to the lower side of the frame and a lower end which sealingly engages the cylinder inner sidewall. This geometrical configuration forms an annulus between the bushing, frame, and upper resilient member, while a lower annulus is formed between the cylinder wall, lower side of the frame, and the lower resilient element. An intake port is arranged for flow into the lower annulus. As the pump reciprocates, fluid flows from outside the pump, through the intake port, into the lower annulus, across the lower seal surface, into the lower cylinder, where the lower piston forces the fluid to flow through the exhaust port, into the upper annulus, and across the seal surface formed between the bushing and the upper end of the exhaust valve element.

8 Claims, 5 Drawing Figures

RESILIENT INTAKE AND EXHAUST VALVE

BACKGROUND OF THE INVENTION

An intake and exhaust valve combination is required for downhole pumps in order to provide a means for intaking fluid and providing a seal against backflow of the formation fluid, while at the same time providing means for exhausting fluid while providing a seal against backflow of the exhausted fluid.

Coberly, U.S. Pat. No. 2,081,222, sets forth a valve assembly for fluid operated pumps. The valve is comprised of spring loaded caged balls positioned on opposite sides of a plate element which includes a valve seat thereon such that the balls alternately sealingly engage the seat during reciprocation of the pump disclosed therein.

Roeder, U.S. Pat. No. 4,032,266, discloses an improvement over the Coberly valve assembly by the provision of a unique valve seat and cage assembly which cooperates with the ball check valve thereof.

In each of the above valve assemblies, the metal to metal contact between the ball and seat causes rapid wear to occur, especially when contamination with abrasive material takes place within the pump. Production of sand cuts the metal seating surfaces. The plurality of expensive balls are sometimes chipped, pitted, or washed into an oblated configuration by the flowing production fluid.

Sometimes production conditions are encountered wherein the balls are impacted in a peculiar manner against the seat, called pounding, whereupon the balls, followers, housing, and seats are destroyed and continued pumping action rapidly wears the pump because of the absence of lubricant therewithin.

Accordingly, it is desirable to have made available an improved intake and exhaust assembly for a downhole pump which eliminates balls, seats, springs, and other mechanical moving metal parts. It is desirable that such an apparatus be inexpensive, efficient in operation, and less likely to encounter the above mentioned problems peculiar to the present metal ball and seat valve assembly of the prior art.

SUMMARY OF THE INVENTION

A new valve assembly in combination with a hydraulically actuated downhole pump. The pump has spaced pistons connected together by a common connecting rod so that the pistons reciprocate within a cylinder. The cylinder is separated into an upper and lower cylinder chamber by the valve assembly. The valve assembly includes a frame supported from the cylinder wall and arranged laterally with respect to the longitudinal axial centerline of the connecting rod. A bushing is positioned centrally of the frame and sealingly engages a reciprocating marginal length of the connecting rod. An exhaust port is formed through the frame and spaced from the bushing. A resilient exhaust valve element surrounds the bushing and has a lower, circumferentially extending edge affixed to the frame outwardly of the exhaust port and further includes an upper seal end which sealingly engages a marginal area of the external surface of the bushing. A lower resilient intake valve element circumferentially extends about the connecting rod in spaced relationship therewith and has an upper end attached to the lower side of the plate and a lower end which sealingly engages the cylinder inner sidewall. An upper annulus is formed between the bushing, frame, and upper resilient member, while a lower annulus is formed between the cylinder wall, lower side of the frame, and the lower resilient element. An intake port in the pump cylinder wall is arranged for flow into the lower annulus, while the exhaust port is arranged to enable flow to occur into the upper annulus. As the pump reciprocates, fluid flows from outside the pump, through the intake port, into the lower annulus, across the lower seal surface, and into the lower cylinder chamber. The fluid then flows through the exhaust port, into the upper annulus, and across the seal surface formed between the bushing and the upper end of the exhaust valve element, and into the upper cylinder chamber where the fluid is then forced out of the pump and to the surface of the ground.

Accordingly, a primary object of the present invention is the provision of improvements in intake and exhaust valves for downhole, hydraulically actuated pumps.

Another object of the invention is the provision of a new combination of a downhole pump and an intake and exhaust valve therefor.

A further object of this invention is to disclose and provide a valve assembly having a resilient valve element associated therewith which cooperates with a hydraulically actuated downhole pump in a new and unexpected manner.

A still further object of this invention is the provision of a resilient valve member by which the intake and exhaust fluids which flow into a pumping chamber are effectively checked against backflow.

Still another object of this invention is the provision of an improved dual check valve assembly which has no moving metallic parts.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENT

Throughout the remainder of this specification, wherever it is possible or logical to do so, like or similar numerals will generally refer to like or similar parts.

Figure 1:
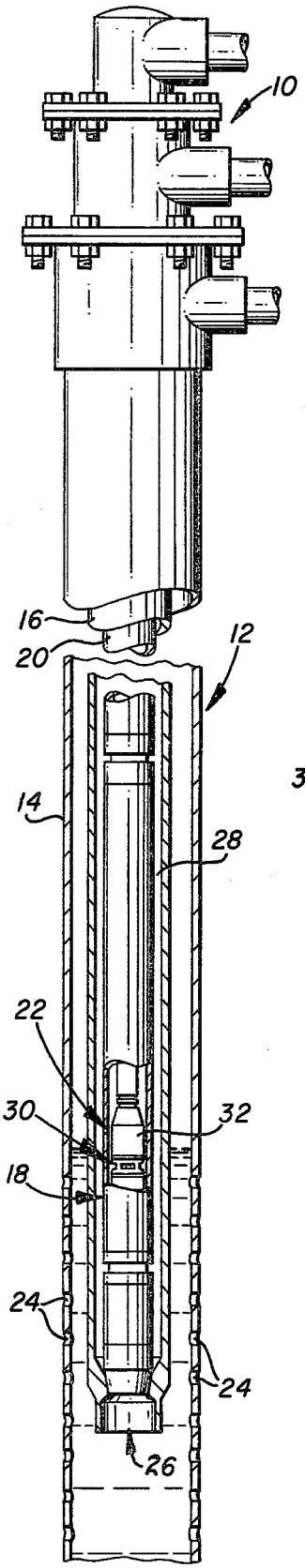
FIG. 1 is a part cross-sectional, side elevational view of a producing wellbore having a downhole, hydraulically actuated pump disposed therein which includes a valve combination made in accordance with the present invention.

In FIG. 1 there is disclosed a producing oil well having a Cristmas tree 10 which extends above the ground in the usual manner in order that flow of hydrocarbons therefrom can be connected into a gathering system. The wellbore extends below the ground as seen at 12 and to a lower production zone from which hydrocarbon fluid is produced. The well is cased at 14 and includes a produced fluid pipe or tubing 16, which receives fluid flow from a downhole, hydraulically actuated pump 18. Power fluid flows downhole through the innermost power fluid tubing 20 and to the engine of the pump.

The pump barrel 22 has the lower end thereof in the form of a seat so that it sealingly engages a seating shoe is the usual manner. Production fluid flows through the perforated casing at 24 and into the lowermost inlet end 26 of the apparatus. The pump forces fluid from 24 to flow into the inlet 26, through the pump and up through the production annulus 28, and to the surface of the ground. It should be understood that a free-type pump, as well as other type pumps, can be used in conjunction with the present invention.

The pump assembly has a valve assembly 30 included therein made in accordance with the present invention. The pump includes an inner housing 32 within which various spaced cylinder chambers are formed.

Figure 2:
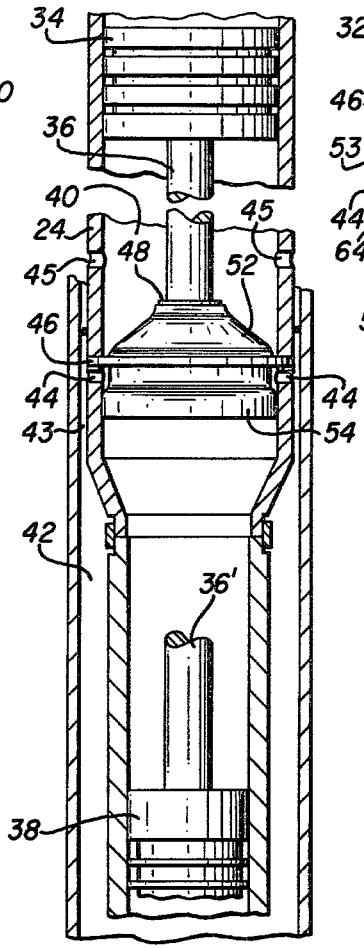
FIG. 2 is an enlarged, part cross-sectional, broken, detailed view of part of the apparatus disclosed in FIG. 1.

As seen in FIG. 2, together with other figures of the drawings, upper piston 34 is affixed to a connecting rod 36 which extends downhole at 36' for connection to a lower pump piston 38. The before mentioned inner housing therefore forms an upper cylinder chamber 40 within which upper piston 34 reciprocates; and, a lower cylinder chamber 41 within which the lower piston 38 reciprocates.

Production fluid flows from the inlet 26, into the annular passageway 42 while passageways 43 provide production fluid for each of the working chambers of the pump assembly. Inlet ports 44 are radially spaced and formed through the inner housing, while exhaust ports 45 are likewise radially spaced in misaligned relationship respective to passageways 43 so that produced fluid can flow from the exhaust port, and up through the production annulus.

The valve assembly 30 of the present invention includes a frame 46 having an outer, circumferentially extending, marginal edge portion captured between the upper and lower cylindrical parts which form the pump cylinder, thereby dividing the axial or central bore formed by the inner housing into the before said upper and lower cylinder chambers. The frame can be secured in its illustrated lateral or horizontal position by employment of other design expedients, if desired.

A bushing 48 is provided with a longitudinally extending axial bore 49 and is integrally connected to the frame. Radial flow ports 50 are formed outwardly of the bushing, inwardly of the cylinder wall, and through the frame.

A resilient exhaust valve element 52 is bonded at the lower end 53 thereof to the upper face of the frame and extends 360° about the bushing in spaced relationship respective to the cylindrical sidewalls. A resilient intake valve element 54 includes an upper circumferentially extending end which is likewise bonded to the lower face of the frame at 55 and extends downhole into sealed engagement respective to the circumferentially extending cylindrical sidewall of the lower cylinder chamber.

The upper free end 56 of the exhaust valve element sealingly engages the upper, marginal, outer surface area of the bushing and is biased into engagement therewith so that considerable force is required in order to lift the seal surface 56 from sealed engagement with the outer surface of the bushing. The memory of the rubber or rubberlike valve element causes the element to normally assume a sealed or closed configuration.

In a similar manner, the intake valve element includes a seal surface at 57 which circumferentially extends 360° in spaced relation about the connecting rod and is urged against the circumferentially extending cylindrical surface of the lower cylinder chamber because of the memory of the rubberlike substance from which the seal is fabricated.

Figure 4:
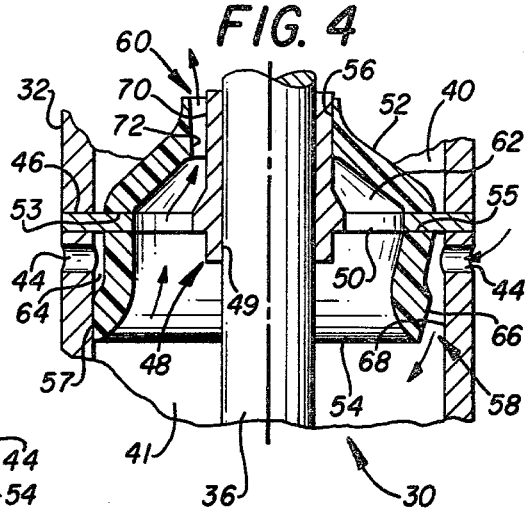
FIG. 4 is a cross-sectional view of the apparatus disclosed in the foregoing figures; and, FIG. 5 is a cross-sectional view taken along line 5—5 of FIG. 3.
Figure 5:
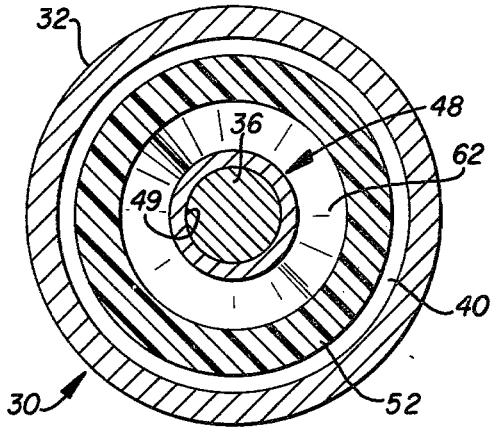
Figure 3:
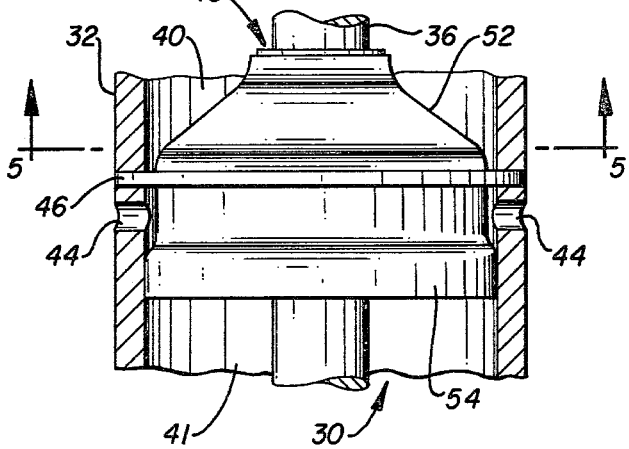
FIG. 3 is a further enlarged, broken, part cross-sectional, side elevational view of part of the apparatus disclosed in FIG. 2.

As particularly seen disclosed in the hypothetical illustration of FIG. 4, the valve assembly is depicted on the left side as being on the exhaust stroke while the right side of FIG. 4 shows the action of valve assembly during the intake stroke. As further seen in the right hand side of FIG. 4, the intake element 54 is spaced from the cylinder wall as indicated by the arrow at numeral 58 for the reason that the pump is on the downstroke, thereby drawing fluid through intake port 44, into annular flow chamber 64, across the separated seal surface at 58, and into the pump chamber 41.

As the pump upstrokes, the memory of element 54 causes the seal surface at 57 to be biased against the cylinder wall at 68 as fluid flows from chamber 41, through the radial valve frame ports 50, into upper valve annulus 62, and across the seal surface at 60, thereby causing the surfaces at 70 and 72 to part in the illustrated manner disclosed therein. The fluid flows into chamber 40, through exhaust port 45, and up through the production annulus to the surface of the ground.

The present invention provides a compact, highly reliable, long lasting, inexpensive valve assembly which can be substituted for various prior art valve assemblies, as illustrated in the above Coberly and Roeder patents, for example.

Accordingly, the present invention is directed to a valve assembly for a downhole pump wherein the pump has spaced pistons 34, 38 connected together by a connecting rod 36. The valve assembly 30 divides the cylindrical housing 32 into upper and lower chambers 40 and 41 within which the pistons reciprocate. The valve assembly includes a bushing 48 which sealingly and slidably engages the connecting rod. The bushing radiates into a frame 46 so that the bushing is supported from the pump housing or cylinder. A port 50 is formed outwardly of the bushing and inwardly of the cylinder wall, and is in communication with an annulus 62 formed by a resilient exhaust valve element 52. The exhaust valve element is attached to the frame outwardly of the exhaust ports as noted at 53, and the upper end of the element is sealingly biased into engagement with the bushing at 56, thereby precluding backflow of produced fluid, while at the same time admitting outflow of produced fluid thereacross.

The resilient intake valve element 54 is attached to the other side of the frame in spaced relationship to the exhaust port 50 with the lower marginal end of the element downwardly extending into sealed engagement with the circumferentially extending sidewall of the cylinder as noted by numeral 57. The intake valve element forms an annular intake chamber 64 which is in communication with intake ports 44. The lower, outer, sealed marginal end of the element is urged against the sidewall of the cylinder and can be urged away therefrom by the action of the suction stroke of the piston associated with chamber 41.

Accordingly, the upper and lower resilient valve elements 52 and 54 prevent backflow of fluid from chambers 40 and 41 during the pumping operation and enable the piston within chamber 41 to force formation fluid from port 66, into annulus 64, across the sealed surface at 58, into chamber 41, through exhaust ports 50, into annular chamber 62, across seal surface 60 and through the production port of the pump, where the fluid is subsequently forced to continue to flow to the surface of the ground.

Where the valve is used on the end of a pump where no rod 36 passes through the bushing 48 for connection to a piston 34, the axial passageway 49 can be sealed thereby providing a valve assembly located in the head of the cylinder 41.

I claim:

1. A downhole pump assembly having spaced pistons connected together by a connecting rod, a cylinder within which said pistons reciprocate, a valve assembly having a bushing; said bushing has an axial passageway formed therethrough which sealingly receives said connecting rod in slidable relationship therethrough, and divides the cylinder into upper and lower cylinder chambers;

a frame by which said bushing is supported from said cylinder, an exhaust port formed through said frame;

a resilient exhaust valve element having a lower, circumferentially extending end portion attached to said frame, and an upper circumferentially extending seal surface which sealingly engages a marginal length of said bushing such that an exhaust chamber is formed between the bushing, frame, and exhaust valve element with said exhaust port being in communication with said chamber;

a resilient intake valve element having an upper circumferentially extending end portion affixed to the other side of the frame with said exhaust port being located inwardly thereof; and, a lower circumferentially extending seal surface which sealingly engages said cylinder wall; a lower annular chamber formed between the cylinder wall, frame, and intake valve element;

means forming an inlet port which is connected to the last said annular chamber so that fluid can flow into the lower annular chamber, across the lower seal surface of said intake valve element, into the lower cylinder chamber, through the exhaust port of the frame, into the upper annular chamber, and across the upper seal surface where the fluid can then flow from the pump assembly and to the surface of the ground.

2. The valve assembly of claim 1 wherein said bushing is a hollow, cylindrical member having one end which radiates into said frame with the outer, circumferentially extending marginal edge of the frame being supported by the cylinder, the other end of the bushing extends from said frame and presents an outer circumferentially extending cylindrical surface which sealingly engages the first recited seal surface.

3. The valve assembly of claim 1 wherein said resilient exhaust valve element is made of rubber and has the lower end thereof vulcanized to the upper face of the frame; and said intake valve element is made of rubber and has the upper end thereof vulcanized to the other side of the frame.

4. The valve assembly of claim 1 wherein said bushing is a hollow, cylindrical member having one end which radiates into said frame with the outer, circumferentially extending marginal edge of the frame being supported by the cylinder, the other end of the bushing extends from said frame and presents an outer circumferentially extending cylindrical surface which sealingly engages the first recited seal surface;

said resilient exhaust valve element is made of rubber and has the lower end thereof vulcanized to the upper face of the frame; and said intake valve element is made of rubber and has the upper end thereof vulcanized to the other side of the frame.

5. A valve assembly in combination with a pump apparatus, the pump apparatus having a cylinder, a piston, and a connecting rod by which the piston is reciprocated within the cylinder;

said valve assembly includes a bushing which radiates into a frame, with the frame being attached to the cylinder wall of the pump to divide the cylinder into upper and lower chambers;

said bushing extends upwardly from said frame and includes a circumferentially extending marginal end which forms an outer surface spaced from said cylinder wall;

an upper resilient valve element having an upper and lower end, the lower end of said valve element being affixed to the upper side of said frame, while the upper end of said valve element sealingly engages the upper marginal end of said bushing, thereby leaving an annulus formed between the bushing, frame, and valve element;

a lower resilient valve element having an upper and lower end, with the upper end thereof being attached to the other side of said frame and extending downwardly therefrom such that the lower marginal end thereof extends like a skirt into sealed engagement with an upper marginal, circumferentially extending length of the inside peripheral wall of the cylinder chamber;

a radial exhaust port formed through said frame and located between said bushing and each of said resilient valve elements; said intake valve element cooperates with the cylinder wall and the frame to form an annular chamber therebetween;

so that reciprocation of the piston forces fluid to flow into the lower annular chamber, across the lower seal surface, into the cylinder chamber, where the fluid then is forced to flow through the radial exhaust port, into the upper annular chamber, across the upper seal surface, and into the upper chamber, where fluid can then flow from the pump apparatus.

6. The combination of claim 5 wherein said bushing is a hollow, cylindrical member having one end which radiates into said frame with the outer, circumferentially extending marginal edge of the frame being supported by the cylinder, the other end of the bushing extends from said frame and presents an outer circumferentially extending cylindrical surface which sealingly engages the upper end of said upper resilient valve element.

7. The combination of claim 5 wherein said upper resilient valve element is made of rubber and has the lower end thereof vulcanized to the upper face of the frame; and said lower resilient valve element is made of rubber and has the upper end thereof vulcanized to the other side of the frame.

8. The combination of claim 5 wherein said bushing is a hollow, cylindrical member having one end which radiates into said frame with the outer, circumferentially extending marginal edge of the frame being supported by the cylinder, the other end of the bushing extends from said frame and presents an outer circumferentially extending cylindrical surface which sealingly engages the upper end of said upper resilient valve element;

said lower resilient valve element is made of rubber and has the lower end thereof vulcanized to the upper face of the frame; and said upper resilient valve element is made of rubber and has the upper end thereof vulcanized to the other side of the frame.

* * * * *